US006725782B1

(12) United States Patent
Bloom et al.

(10) Patent No.: US 6,725,782 B1
(45) Date of Patent: Apr. 27, 2004

(54) RAILROAD TEST VEHICLE COMPRISING A RAILROAD MEASUREMENT AXLE SUSPENSION

(75) Inventors: Jeffrey A. Bloom, Silver Spring, MD (US); Gary A. Carr, Fairfax, VA (US); Georg Seyrlehner, Chesapeake, VA (US); Ta-Lun Yang, McLean, VA (US); Günther W. Oberlechner, Virginia Beach, VA (US)

(73) Assignees: Franz Plasser Bahnbaumaschinen-Industriegesellschaft m.b.H, Vienna (AT); Ensco, Inc., Springfield, VA (US)

( * ) Notice: Subject to any disclaimer, the term of this patent is extended or adjusted under 35 U.S.C. 154(b) by 0 days.

(21) Appl. No.: 10/395,638

(22) Filed: Mar. 24, 2003

(51) Int. Cl.[7] ..... B61C 11/00

(52) U.S. Cl. ..... 105/27; 105/26.05; 105/215.1; 105/157.1; 104/2; 33/1 Q

(58) Field of Search ..... 104/2; 105/26.05, 105/157.1, 165, 171, 174, 175.1, 177, 179, 215.1, 216, 27; 33/1 Q, 264, 267, 287, 338; 73/636

(56) References Cited

U.S. PATENT DOCUMENTS 4,044,594 A * 8/1977 Owens et al. ..... 73/621
4,468,966 A * 9/1984 Bradshaw ..... 73/636
4,662,224 A * 5/1987 Turbe ..... 73/636
5,203,089 A * 4/1993 Trefouel et al. ..... 33/338
5,756,903 A * 5/1998 Norby et al. ..... 73/786
5,778,798 A * 7/1998 VanDenberg ..... 105/215.2
6,405,141 B1 * 6/2002 Carr et al. ..... 702/36
2003/0172837 A1 * 9/2003 Whiston et al. ..... 105/215.2

* cited by examiner

*Primary Examiner*—Mark T. Le
(74) *Attorney, Agent, or Firm*—Collard & Roe, P.C.

(57) ABSTRACT

A railroad test vehicle extending in a longitudinal direction comprises a measurement axle comprising two flanged wheels rotatable about a measuring axis extending transversely to the longitudinal direction and adapted to run on two track rails. A cross member extends transversely to the longitudinal direction, is vertically spaced from an underside of the vehicle and is affixed thereto. The connection between the measurement axle and the cross member comprises two trunnions transversely spaced from each other and mounted on the cross member, each trunnion defining a clearance with the cross member sufficient to enable the trunnion to be freely tilted to either side of the vehicle about an axis extending in the longitudinal direction, a support frame mounted on each trunnion for pivoting freely about an axis extending perpendicularly to the longitudinal direction, and two pairs of linkages, the pairs being transversely spaced from each other by the same distance as the transversely spaced trunnions. Each pair comprises an upper swing arm and a lower swing arm spaced from the upper swing arm in a vertical direction. A joint connects each swing arm to the measurement axle, and a hinge connects each swing arm either to a respective one of the support frames. At least one pressure cylinder having a vertically extending cylinder axis exerts a contact force pressing the measurement axle against the rails.

5 Claims, 5 Drawing Sheets

RAILROAD TEST VEHICLE COMPRISING A RAILROAD MEASUREMENT AXLE SUSPENSION

BACKGROUND OF THE INVENTION

1. Field of the Invention

The present invention relates to a railroad test vehicle extending in a longitudinal direction along a railroad track having two rails and adapted to run on the track, which comprises a measurement axle comprising two flanged wheels rotatable about a measuring axis extending transversely to the longitudinal direction and adapted to run on the rails, and means connecting the measurement axle to an underside of the vehicle.

2. Description of the Prior Art

Such railroad test vehicles are designed among other things to measure the strength of the attachment of the track rails to the crossties, which is important in maintaining the integrity of the railroad track. A measurement carriage or axle is used to push against the side of the rail and measure movement of the track rail with respect to the crosstie. The measurement axle assembly must follow the track rails and load the rails vertically and laterally against the inner face of the head of the rails for purposes of testing the attachment of the rails to the crossties. Measurement axles of this kind have been incorporated, for example, as one of the running axles of a railroad test vehicle or have been suspended from an underside of a railroad test vehicle by some type of guidance system.

SUMMARY OF THE INVENTION

It is the primary object of this invention to provide a railroad test vehicle wherein the measurement axle is suspended from an underside of the railroad test vehicle for operation separately from the running axles of the vehicle while it may be lifted and lowered for use, when necessary, and stored at will, when not needed. If the measurement axle derails, the overall vehicle safety is not endangered. The measurement axle is suspended in such a way that, regardless of the roll, pitch or vertical movement of the railroad test vehicle body on its resilient suspension, or the curvature, profile, alignment and cross-level of the track, the flanged wheels of the measurement axle are always kept on their respective rails and the vertical load always remains perpendicular to the upper surface of the rail.

The above and other objects are accomplished according to the invention in a railroad test vehicle of the first-described type by providing a cross member extending transversely to the longitudinal direction, vertically spaced from an underside of the vehicle and affixed thereto, and means connecting the measurement axle to the cross member and permitting the measurement axle to be freely tilted about an axis extending in the longitudinal direction and to be freely pivoted about an axis extending perpendicularly to the longitudinal direction. The connecting means comprises two trunnions transversely spaced from each other and mounted on the cross member. Each trunnion defines a clearance with the cross member sufficient to enable the trunnion to be freely tilted to either side of the vehicle about the axis extending in the longitudinal direction. A support frame is mounted on each trunnion for pivoting freely about the axis extending perpendicularly to the longitudinal direction. Two pairs of linkages are transversely spaced from each other by the same distance as the transversely spaced trunnions, and each pair comprises an upper swing arm and a lower swing arm spaced from the upper swing arm in a vertical direction. A joint connects each swing arm to the measurement axle, and a hinge connects each swing arm to a respective one of the support frames. At least one pressure cylinder having a vertically extending cylinder axis and exerting a contact force presses the measurement axle against the rails.

With such connecting means, the measurement axle is kept in contact with the railroad track regardless of the movement of the railroad test vehicle on its conventional resilient suspension and regardless of the track curvature. The structure further insures that the pressure cylinders are always aligned in such a manner that the vertical force pressing the flanged wheels of the measurement axle against the rails is always perpendicular to a plane defined by the running surfaces of the rails.

Furthermore, the measurement axle may be pressed against the running surfaces of the rails with a load which is always perpendicular to a line formed by the wheel contact surfaces of the rails engaged by the flanged wheels as the railroad test vehicle moves on its resilient suspension along the track, and the track curvatures and/or the track cross level changes. The measurement axle is so oriented that the flanged wheels thereof are tangent to the rails as the track curvature varies.

BRIEF DESCRIPTION OF THE DRAWING

The above and other objects, advantages and features of this invention will become more apparent from the following detailed description of a now preferred embodiment thereof, taken in conjunction with the accompanying, somewhat schematic drawing wherein.

DETAILED DESCRIPTION OF THE PREFERRED EMBODIMENT

Figure 1:
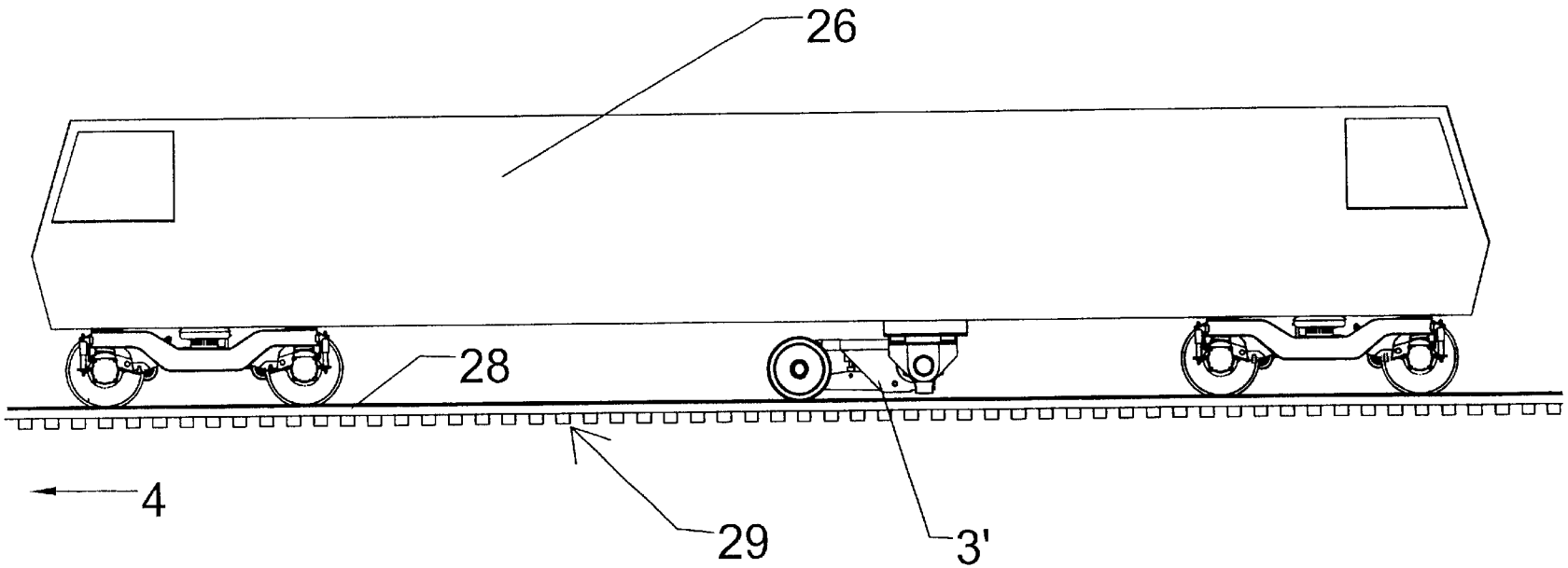
FIG. 1 is a simplified side view of a railroad test vehicle with the measurement axle assembly attached to an underside of the vehicle.

Throughout the drawing, like reference numerals designate like parts functioning in a like manner in all figures.

Referring first to FIG. 1, there is shown railroad test vehicle 26 extending in a longitudinal direction indicated by arrow 4 and adapted to run on track 29 having two rails 28. The vehicle comprises a measurement axle assembly 3' arranged underneath an underside of the vehicle. As will be described hereinafter in conjunction with FIGS. 2–6, the railroad test vehicle comprises measurement axle 3 comprising two flanged wheels 2 rotatable about measuring axis 1 extending transversely to the longitudinal direction and adapted to run of track rails 28. The flanges of flanged wheels 2 may be forced laterally against the side of the heads of rails 28 by hydraulic or pneumatic cylinders (not shown) arranged within measurement axle 3.

Cross member 11 extends transversely to the longitudinal direction, is vertically spaced from an underside of the vehicle and is affixed thereto by brackets 27 affixed to the vehicle at the sides thereof.

According to the present invention, the means provided to connect measurement axle 3 to cross member 11 permits measurement axle 3 to be freely tilted about axis 18 extending in the longitudinal direction and to be freely pivoted about vertical axis 15 extending perpendicularly to the longitudinal direction. The connecting means comprises two trunnions 6 transversely spaced from each other and mounted on cross member 11. Each trunnion defines clearance 6*a* with the cross member sufficient to enable the trunnion to be freely tilted to either side of the vehicle about axis 18 extending in the longitudinal direction. A support frame 14 is mounted on each trunnion 6 for pivoting freely about axis 15 extending perpendicularly to the longitudinal direction.

Figure 2:
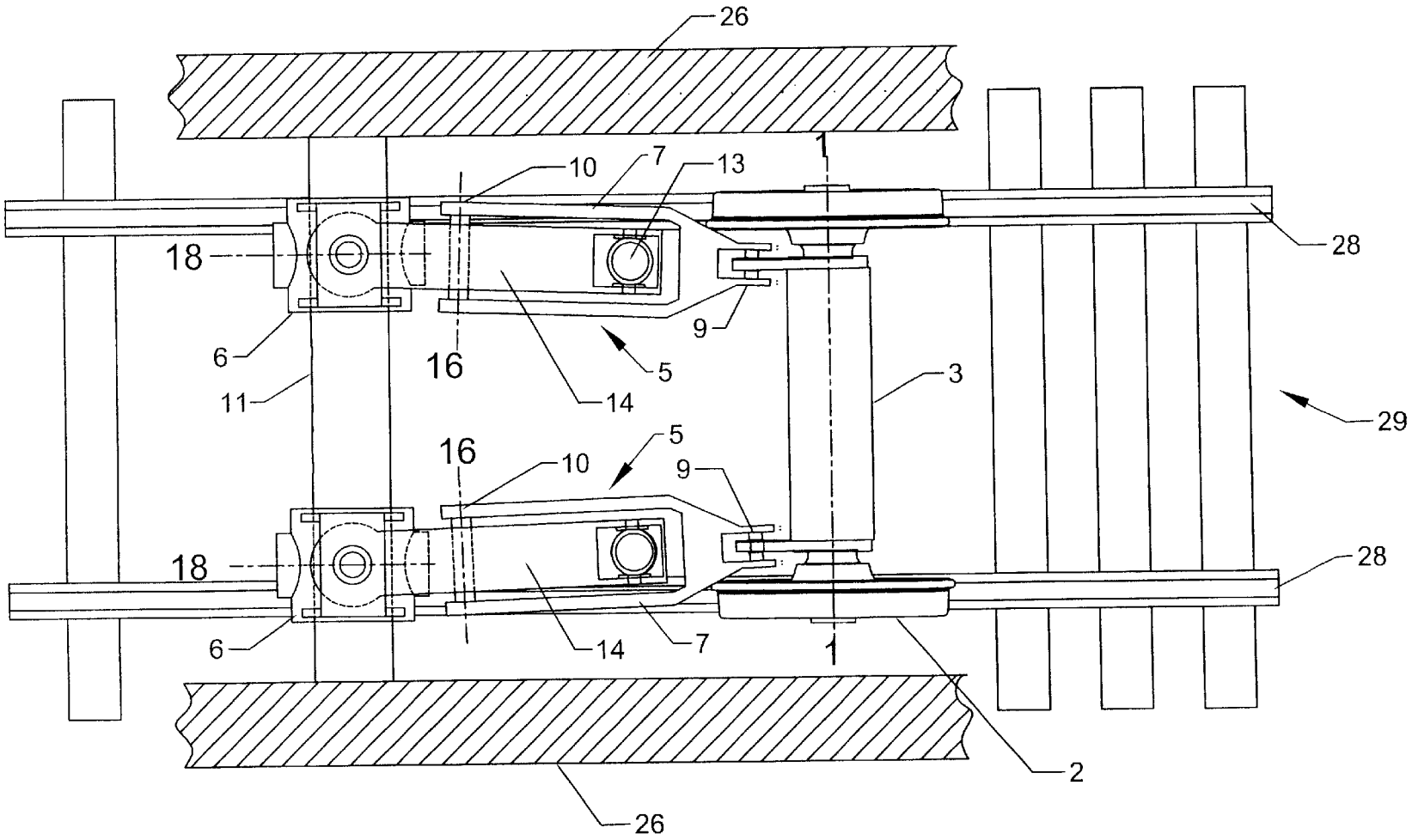
FIG. 2 is a schematic plan view of the measurement axle assembly according to the now preferred embodiment of the invention.

Two pairs of linkages 5 are transversely spaced from each other by the same distance as the transversely spaced trunnions 6. Each pair 5 comprises an upper swing arm 7 and a lower swing arm 8 spaced from the upper swing arm in a vertical direction. As shown in FIG. 2, upper swing arms 7 and lower swing arms 8 preferably are not parallel to each other in a horizontal plane defined by the swing arms, allowing flanged wheels 2 to be parallel to rails 28 as the rail curvature varies. A joint 9 connects each swing arm to measurement axle 3, and a hinge 10 connects each swing arm to a respective support frame 14. At least one pressure cylinder 13 having vertically extending cylinder axis 12 exerts a contact force pressing measurement axle 3 against rails 28.

Figure 3:
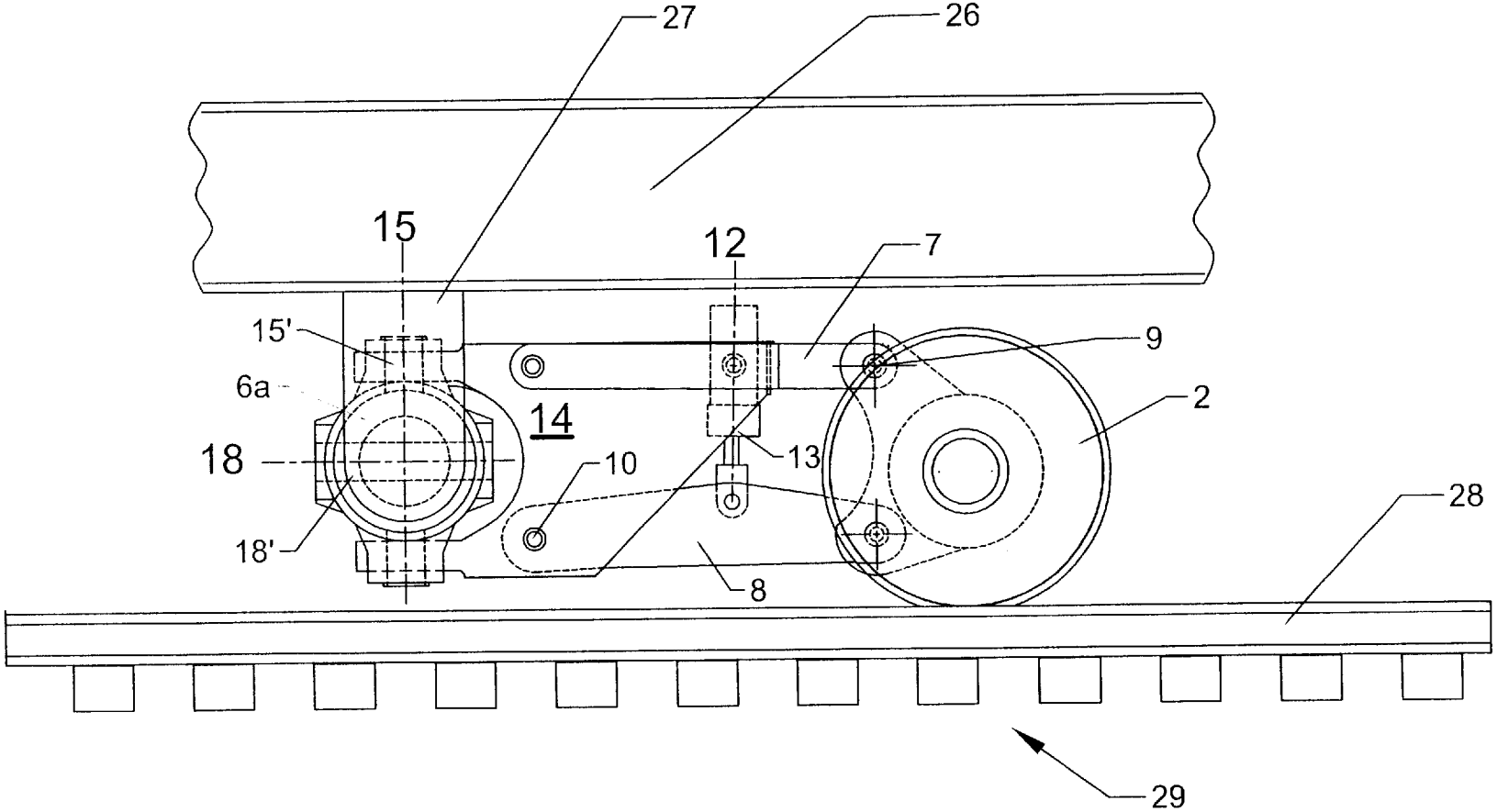
FIG. 3 is a detailed side view of the measurement axle assembly shown in FIG. 2, partly in section.
Figure 4:
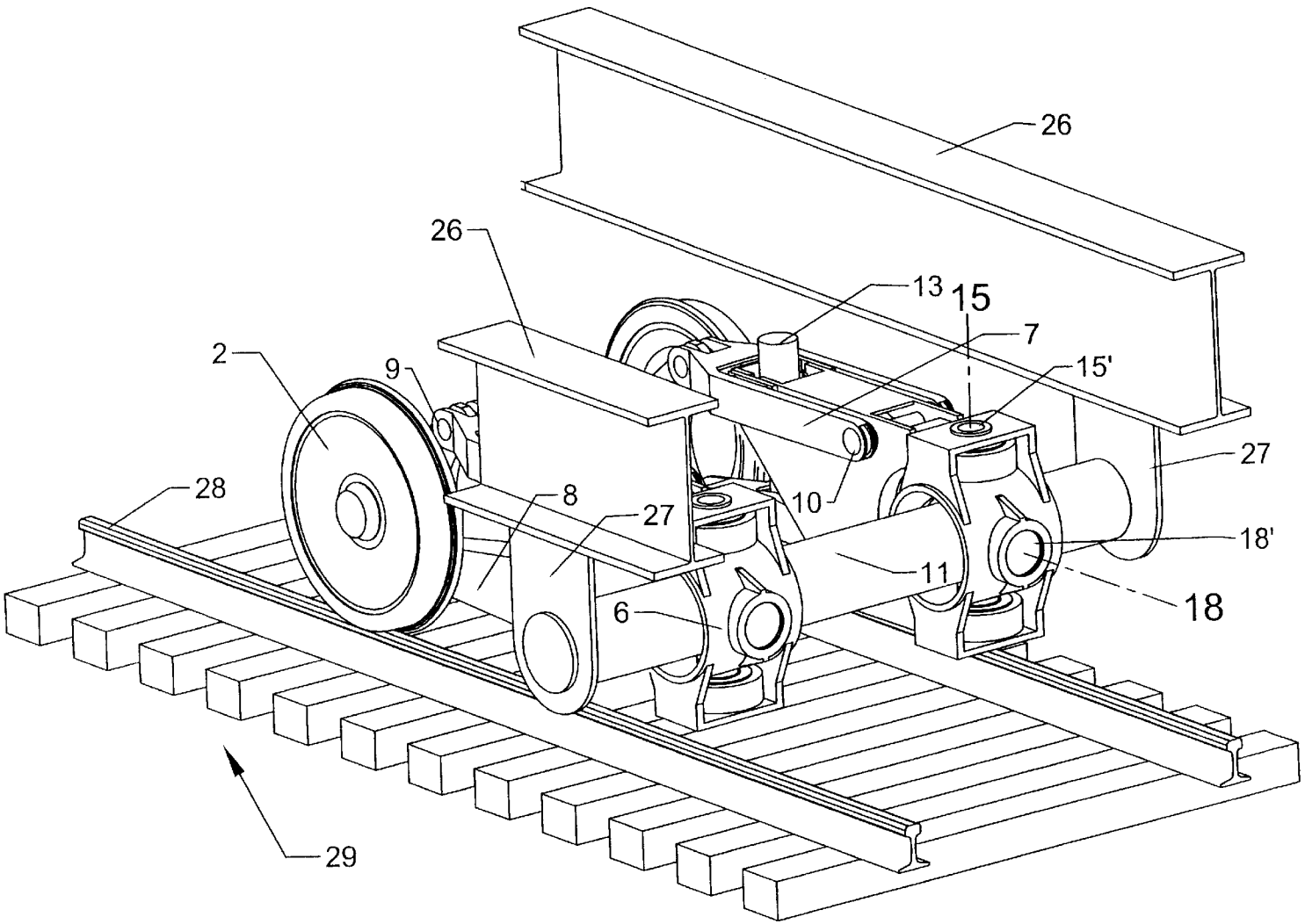
FIG. 4 is a fragmentary perspective view of the measurement axle assembly shown in FIG. 2, illustrating the mounting of the two trunnions on the cross member, the mounting of two support members on the trunnions and the hinges connecting the swing arms of each pair to the support members.

As shown in FIGS. 2–4, pins 18' extending in the longitudinal direction connect the two trunnions 6 to cross member 11 which extends in a plane parallel to the underside of vehicle 26 and perpendicularly to the longitudinal direction. Trunnions 6 define clearance 6*a* with cross member 11 sufficient to enable the trunnions to be freely tilted on pins 18' about axis 18. Clearance 6*a* is sufficient to permit tilting of trunnions 6 about axis 18, preferably up to about 10°. Tilting of trunnions 6 about axis 18 allows measurement axle 3 to orient itself according to the cross level of track 29, as the railroad test vehicle rolls or the track cross level varies.

A support frame 14 is mounted on each trunnion 6 for pivoting freely on pins 15' about vertical axis 15 extending perpendicularly to the longitudinal direction. Pivoting of support frames 14 about pins 15' allows measurement axle 3 to move laterally with respect to railroad test vehicle 26 to follow any curvature of track 29. Hinge pin 10 articulately connects one end of each swing arm 7, 8 of each pair 5 to support frames 14 so that the swing arms may rotate about axis 16 extending parallel to measuring axis 1. The opposite end of each swing arm is connected to measurement axle 3 by a joint 9.

Figure 5:
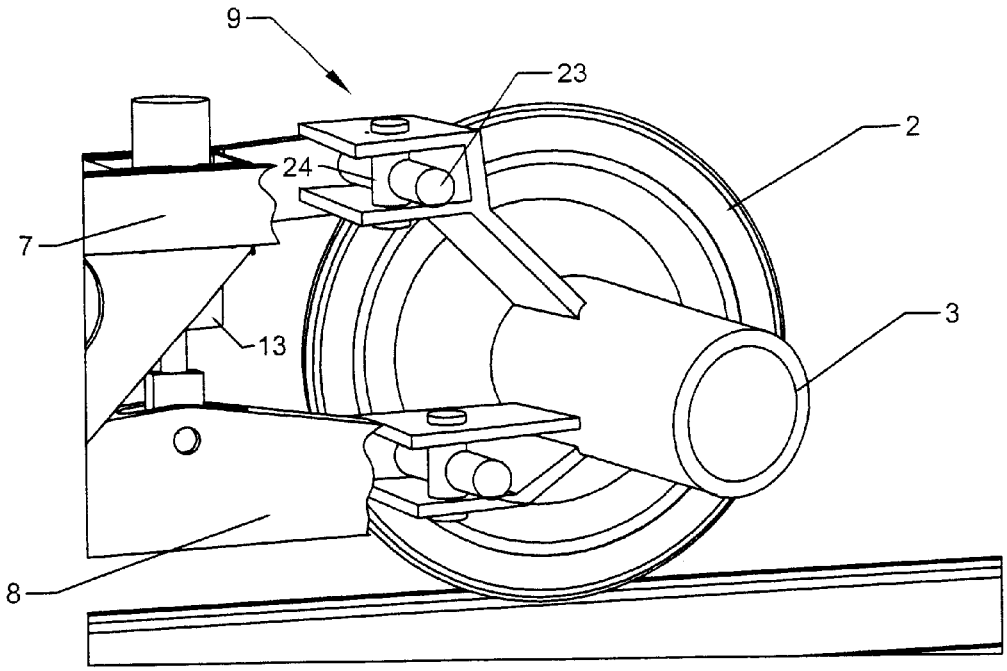
FIG. 5 is a partial perspective view showing the joint connecting each swing arm to the measurement axle as a universal joint allowing rotation about two axes extending orthogonally to each other.
Figure 6:
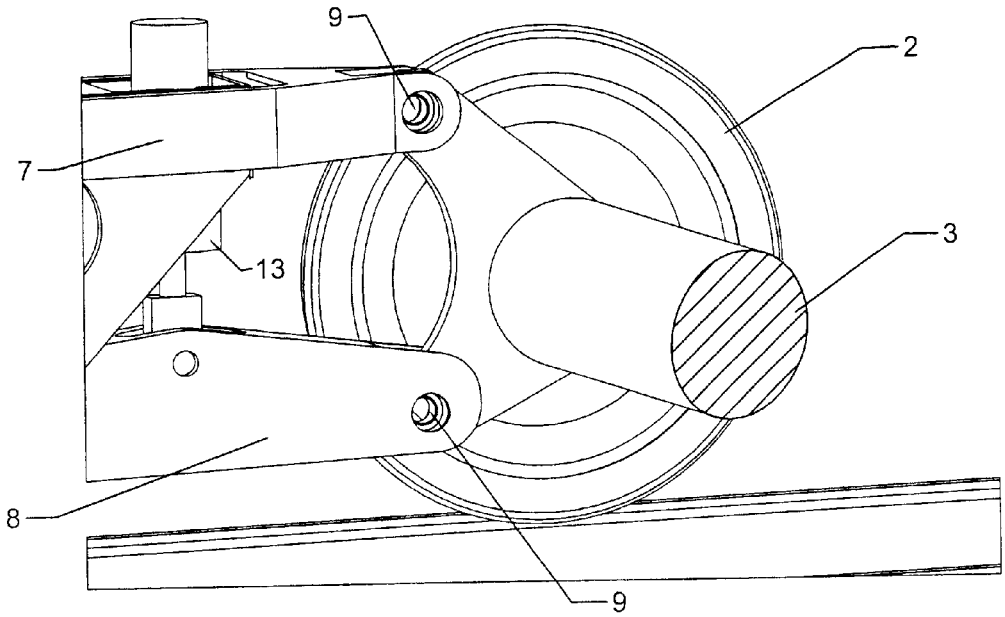
FIG. 6 is a like view showing the joint as a spherical joint.

The joint may be a spherical joint, i.e. a ball-and-socket joint, as shown in FIG. 6, or a universal joint allowing rotation about two axles 23, 24 extending orthogonally to each other, as shown in FIGS. 5 and 6. Universal joint axis 23 extends substantially parallel to measurement axle 3 and axis 24 encloses an angle of 90° therewith and extends vertically with respect to the measurement axle. Such joints permit mobility in all directions.

It is important to note that frames 14 are joined only to trunnions 6 by pins 15', while trunnions 6 are joined only to cross member 11 by pins 18'. Pins 15' may be rotatable on trunnions 6, in which case frames 14 are affixed thereto, or the pins may be affixed to the trunnions and the frames may be journaled on the pins for rotation. Likewise, pins 18' may be rotatable on cross member 11, in which case trunnions 6 are affixed thereto, or the pins may be affixed to the cross member and the trunnions may be journal on the pins for rotation.

At least one pressure cylinder 13 having a vertically extending cylinder axis 12 is associated with each pair 5 of swing arms 7, 8. As shown in FIG. 3, each pressure cylinder 13 has an upper end linked to a respective support frame 14 and a lower end to a respective lower swing arm 8. Thus, the pressure cylinders press lower swing arms 8 down and exert a contact force pressing measurement axle 3 against rails 28. The pressure cylinders may also be used to raise and lower measurement axle 3 to place the measurement axle selectively in an operative, rail-engaging position, shown in full lines in FIG. 3, and an inoperative (stored) position, shown in phantom lines.

Summarizing, the major advantages of the present invention include:

Allowing measurement axle 3 to seek and follow the track as it shifts laterally and drops vertically, as well as during roll variations of the railroad test vehicle.

Allowing the measurement axle to be pulled along by the railroad test vehicle to which it is connected while maintaining a controlled angle of engagement with the track rails and pitch angle.

Allowing known and controlled vertical forces to be applied to the two flanged wheels 2 of measurement axle 3 in a direction extending perpendicularly to a line joining the two contact points of the flanged wheels with the track rails.

Ensuring that the direction and magnitude of the forces applied to the measurement axle are not affected by any dynamic railroad test vehicle body bounce, lateral translation and roll.

Ensuring that the flanged wheels remain parallel to the rails even as the curvature of the track changes.

What is claimed is:

1. A railroad test vehicle extending in a longitudinal direction and adapted to run on a track having two rails, which comprises (a) a measurement axle comprising two flanged wheels rotatable about a measuring axis extending transversely to the longitudinal direction and adapted to run on the rails, (b) a cross member extending transversely to the longitudinal direction, vertically spaced from an underside of the vehicle and affixed thereto, (c) means connecting the measurement axle to the cross member and permitting the measurement axle to be freely tilted about an axis extending in the longitudinal direction and to be freely pivoted about an axis extending perpendicularly to the longitudinal direction, the connecting means comprising (1) two trunnions transversely spaced from each other and mounted on the cross member, each trunnion defining a clearance with the cross member sufficient to enable the trunnion to be freely tilted to either side of the vehicle about the axis extending in the longitudinal direction, (2) a support frame mounted on each trunnion for pivoting freely about the axis extending perpendicularly to the longitudinal direction, (3) two pairs of linkages, the pairs being transversely spaced from each other by the same distance as the transversely spaced trunnions, and each pair comprising an upper swing arm and a lower swing arm spaced from the upper swing arm in a vertical direction, (4) a joint connecting each swing arm to the measurement axle, and (5) a hinge connecting each swing arm either to a respective one of the support frames, and (d) at least one pressure cylinder having a vertically extending cylinder axis and exerting a contact force pressing the measurement axle against the rails.

2. The railroad test vehicle of claim 1, wherein the joint connecting each swing arm to the measurement axle is a universal joint allowing rotation about two axes extending orthogonally to each other.

3. The railroad test vehicle of claim 1, wherein the joint connecting each swing arm to the measurement axle is a spherical joint.

4. The railroad test vehicle of claim 1, wherein an upper end of a respective one of the pressure cylinders is linked to a respective one of the support frames and a lower end of a respective one of the pressure cylinders is linked to a the lower swing arm of each pair of linkages.

5. The railroad test vehicle of claim 1, wherein the upper swing arms and lower swing arms are not parallel to each other in a horizontal plane defined by the swing arms, allowing the flanged wheels to be parallel to the rails as the rail curvature varies.

* * * * *